United States Patent [19]

Imai et al.

[11] Patent Number: 4,775,462

[45] Date of Patent: Oct. 4, 1988

[54] NON-OXIDATIVE METHOD OF SWEETENING A SOUR HYDROCARBON FRACTION

[75] Inventors: Tamotsu Imai, Mt. Prospect; Jeffery C. Bricker, Buffalo Grove, both of Ill.

[73] Assignee: UOP Inc., Des Plaines, Ill.

[21] Appl. No.: 65,243

[22] Filed: Jun. 22, 1987

[51] Int. Cl.[4] ..... C10G 27/00

[52] U.S. Cl. ..... 208/189; 208/192; 208/97

[58] Field of Search ..... 208/189, 192, 97

[56] References Cited

U.S. PATENT DOCUMENTS

| | | | |
|---|---|---|---|
| 2,740,747 | 4/1956 | Sweetser | 208/189 |
| 2,764,754 | 11/1956 | Annable et al. | 208/189 |
| 2,769,757 | 11/1956 | Annable et al. | 208/189 |
| 2,800,427 | 7/1957 | Junk, Jr. et al. | 208/254 R |
| 2,988,500 | 6/1961 | Gleim et al. | 208/206 |
| 3,108,081 | 10/1963 | Gleim et al. | 252/428 |
| 3,551,324 | 12/1970 | Lillard | 208/14 |
| 3,783,125 | 1/1974 | Ondrey | 208/189 |
| 3,894,107 | 7/1975 | Butter et al. | 260/668 R |
| 4,156,641 | 5/1979 | Frame | 208/207 |
| 4,208,271 | 6/1980 | Cosyns et al. | 208/189 |
| 4,383,916 | 5/1983 | Gulberlet et al. | 208/189 |

FOREIGN PATENT DOCUMENTS

| | | | |
|---|---|---|---|
| 1565985 | 11/1958 | Canada | 208/189 |
| 1602802 | 8/1960 | Canada | 208/189 |

OTHER PUBLICATIONS

A. N. Glazer, *Annual Rev. Biochem.*, 39, 108 (1970).

W. L. Baker, *J. Chem. Tech. Biotechnol.*, 34A, 227–236 (1984).

*Primary Examiner*—H. M. S. Sneed

*Assistant Examiner*—Helane Myers

*Attorney, Agent, or Firm*—Thomas K. McBride; Eugene I. Snyder; Frank S. Molinaro

[57] ABSTRACT

This invention relates to a non-oxidative method of sweetening a sour hydrocarbon fraction. The method comprises treating a sour hydrocarbon fraction containing mercaptans with an acid-type catalyst in the presence of an unsaturated hydrocarbon at reaction conditions thereby converting said mercaptans to thioethers. Acid type catalysts which may be used include polymeric sulfonic acid resins, intercalate compounds, sollid acid catalysts and acidic inorganic oxide catalysts.

11 Claims, 2 Drawing Sheets

NON-OXIDATIVE METHOD OF SWEETENING A SOUR HYDROCARBON FRACTION

BACKGROUND OF THE INVENTION

Processes for the treatment of a sour hydrocarbon fraction wherein the fraction is treated by contacting said fraction with an oxidation catalyst in the presence of an oxidizing agent and an alkaline component have become well-known and widely practiced in the petroleum refining industry. Said processes are typically designed to effect the oxidation of offensive mercaptans contained in a sour hydrocarbon fraction with the formation of innocuous disulfides—a process commonly referred to as sweetening. The oxidizing agent is most often air. Gasoline, including natural, straight run and cracked gasolines, is the most frequently treated sour hydrocarbon fraction. Other sour hydrocarbon fractions include the normally gaseous petroleum fractions as well as naphtha, kerosene, jet fuel, fuel oil, lube oil, and the like.

A commonly used continuous process for treating a sour hydrocarbon fraction entails treating the distillate in contact with a metal phthalocyanine catalyst dispersed in an aqueous caustic solution to yield a doctor sweet product. The sour hydrocarbon fraction and the catalyst containing aqueous caustic solution provide a liquid-liquid system wherein mercaptans are converted to disulfides at the interface of the immiscible solutions in the presence of an oxidizing agent—usually air. Sour hydrocarbon fractions containing more difficult to oxidize mercaptans are more effectively treated by contacting with a metal chelate catalyst disposed on a high surface area adsorptive support—usually a metal phthalocyanine on an activated charcoal. The sour fraction is treated by contacting with the supported metal chelate catalyst at oxidation conditions in the presence of an alkaline agent. One such process is described in U.S. Pat. No. 2,988,500. The oxidizing agent is most often air admixed with the hydrocarbon fraction to be treated, and the alkaline agent is most often an aqueous caustic solution charged continuously to the process or intermittently as required to maintain the catalyst in the caustic-wetted state.

Heretofore, the practice of catalytically treating mercaptan containing sour hydrocarbon fractions has involved the introduction of alkaline agents, usually sodium hydroxide, into the sour petroleum distillate prior to or during the treating operation. (U.S. Pat. Nos. 3,108,081 and 4,156,641). These patents along with several others which teach improvements of the basic process all deal with an oxidative method of treating mercaptans in a sour hydrocarbon fraction.

U.S. Pat. No. 3,894,107 teaches the conversion of heteroatom compounds to higher hydrocarbons over a particular type of aluminosilicate molecular sieve at temperatures of 300° C.–500° C., in the gas phase. Thus, if mercaptans are used in this process, the resultant products would be higher hydrocarbons and $H_2S$. The formation of $H_2S$ would present a disposal problem. Therefore, because of the $H_2S$ disposal problem and the high temperatures involved, this process is not useful as a hydrocarbon sweetening process.

The present invention discloses a non-oxidative method of sweetening a sour hydrocarbon fraction comprising contacting a mercaptan containing sour hydrocarbon fractions with an acid type catalyst in the presence of an unsaturated hydrocarbon, thereby converting said mercaptans to thioethers. The instant invention has the advantage over the oxidative method of the prior art in that no alkaline agent is involved in the present invention and therefore the problem of disposing of the spent alkaline agent is eliminated.

SUMMARY OF THE INVENTION

It is a broad objective of this invention to present a novel non-oxidative process for treating a sour hydrocarbon fraction. Specifically, one embodiment of the invention is a process for sweetening a sour hydrocarbon fraction containing mercaptans which comprises contacting said sour hydrocarbon fraction containing at least a concentration of an unsaturated hydrocarbon equal to the molar amount of mercaptans present in said sour hydrocarbon fraction with an acid-type catalyst at reaction conditions thereby converting said mercaptans to thioethers and recovering said sweetened hydrocarbon fraction.

In a specific embodiment of this invention a sour hydrocarbon fraction which contains mercaptans and unsaturated hydrocarbons is continuously contacted with an acidic resin thereby converting the mercaptans to thioethers and recovering the sweetened hydrocarbon fraction.

Other objects and embodiments of this invention will become apparent in the following detailed description.

DETAILED DESCRIPTION OF THE INVENTION

Figure 1:
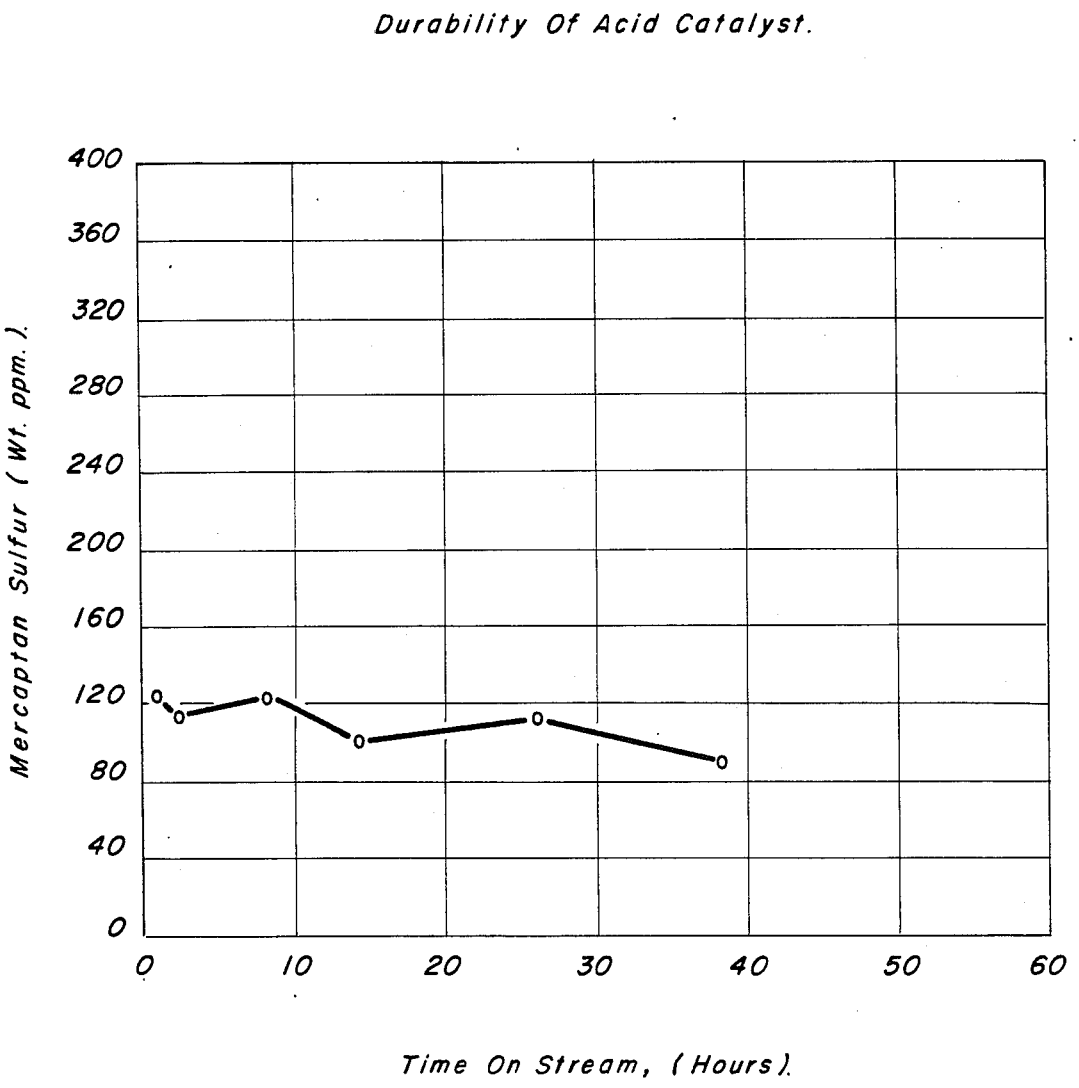
FIG. 1 is a graphical representation of the performance of one of the catalysts of the present invention, catalyst A. The amount of residual mercaptan in the hydrocarbon fraction is plotted versus time on stream.

The reaction of thiols with olefins possessing electron withdrawing functions is known (A. N. Glazer, *Annual Rev. Biochem.*, 39, 108 (1970); W. L. Baker, *J. Chem. Tech. Biotechnol.*, 34A, 227–236 (1984).

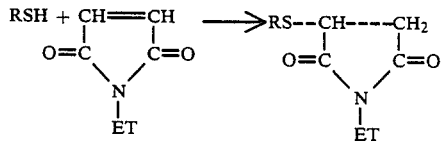

However, this is a stoichiometric reaction which is not useful as a catalytic sweetening agent due to a low reaction rate. This invention describes a catalytic method for converting mercaptans through reaction with unsaturated hydrocarbons and thereby provides a non-oxidative method of sweetening a sour hydrocarbon fraction. A generalized reaction can be written as follows:

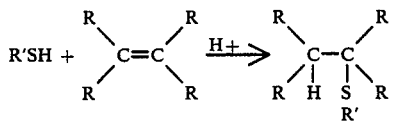

where each R is individually selected from the group consisting of hydrogen, an alkyl hydrocarbon, a cycloalkyl hydrocarbon, an aryl hydrocarbon, an alkaryl hydrocarbon and an aralkyl hydrocarbon. If R is any of the hydrocarbons listed above, the hydrocarbon may contain up to about 25 carbon atoms. It is preferable to choose each R such that the unsaturated hydrocarbon contains a tertiary carbon atom. R'SH represents any mercaptan compound where R' is a hydrocarbon radical containing up to about 25 carbon atoms and is selected from the group consisting of alkyl, cycloalkyl, aryl, alkaryl, and aralkyl.

The above equation shows that an acid type catalyst can catalyze the reaction of mercaptans with an unsaturated hydrocarbon to give thioethers which are acceptable products. Typical catalysts which were found to be effective in promoting the thioetherification reaction include but are not limited to acidic reticular polymeric resins, intercalate compounds, solid acid catalysts, acidic inorganic oxides and metal sulfates. More specifically, examples of acidic polymeric resins are resins which contain a sulfonic acid group. Although both macro-and microreticular polymeric sulfonic acid resins may be used, it is preferred to use macroreticular polymeric sulfonic acid resins. These types of resins are well known in the art and are available commercially.

An intercalate compound is defined as a material which has a layer of cations between the planes of a crystal lattice. Only intercalate compounds which are acidic are contemplated as within the scope of this invention. Examples of acidic intercalate compounds are antimony halides in graphite, aluminum halides in graphite, and zirconium halides in graphite. A preferred intercalate compound is antimony pentafluoride in graphite. Again these compounds are commercially available.

Solid acid catalysts have also been found to catalyze the conversion of mercaptans to thioethers. Examples of solid acid catalysts are phosphoric acid, sulfuric acid or boric acid supported on silica, alumina, silica-aluminas or clays. These acid catalysts are usually prepared by reacting the desired liquid acid with the desired support and drying.

Acidic inorganic oxide catalysts which may be used in this invention may be selected from the group consisting of aluminas, silica-aluminas, natural and synthetic pillared clays, and natural and synthetic zeolites such as faujasites, mordenites, L, omega, X and Y zeolites. Many of these oxides can either be synthesized or preferably can be obtained from commercial sources.

A subgroup of acidic inorganic oxides which are within the scope of the invention are aluminas or silica-aluminas which have been impregnated with aluminum halides or boron halides. A preferred catalyst of this type is boron trifluoride deposited on alumina. Finally, metal sulfates such as zirconium sulfate, nickel sulfate, chromium sulfate, cobalt sulfate, etc. can also be used in this invention.

Regardless of what type of catalyst is employed in the present invention, it is preferred that the catalyst be in particulate form, which particles have an average diameter of less than 4.0 mm. Additionally, it is preferred that the average particle size (average diameter) be in the range of about 105 microns to about 4.0 mm. If the catalyst particle size is smaller than 105 microns, excessive backpressure is created in the treating zone.

Examples of sour hydrocarbon fractions which can be treated using the process of the present invention includes FCC gasoline, kerosene, thermally cracked gasoline, straight run naphtha, LPG and fuel oil. It is preferred that the sour hydrocarbon fraction contain an unsaturated hydrocarbon. In principle, any unsaturated hydrocarbon may be used and may be selected from the group consisting of olefins, diolefins, alkynes, etc. However, it is preferable to utilize an unsaturated hydrocarbon which is capable of forming a tertiary carbonium ion in the presence of an acid catalyst. Examples of hydrocarbons which have an unsaturated carbon-carbon bond with one of said unsaturated carbons also being a tertiary carbon atom are isobutylene, 3-methyl-1-butene, 2-methyl-2-butene, 2-methyl-1-butene, 2-methyl-1-pentene, etc. bond and a tertiary carbon atom are particularly preferred.

The concentration of the unsaturated hydrocarbon necessary to carry out the process of the instant invention can vary considerably. However, a concentration of unsaturated hydrocarbon of at least equal to the molar amount of the mercaptans present in said sour hydrocarbon fraction is necessary to effectively carry out the process. In the event that the sour hydrocarbon fraction does not contain an unsaturated hydrocarbon, one can be added to the sour hydrocarbon fraction prior to contact with the fixed bed catalyst. When the unsaturated hydrocarbon is added to the sour hydrocarbon fraction, it is desirable that it be added in a concentration of at least the molar concentration of the mercaptans in said sour hydrocarbon fraction to about 20 weight percent of the sour hydrocarbon fraction. The upper limit is imposed more by economic considerations rather than any practical limitations of the process. A recommended concentration range of unsaturated hydrocarbon is about 0.01 weight percent to about 20 weight percent.

The process of the instant invention is carried out by passing the sour hydrocarbon fraction over a fixed bed acid-catalyst which is installed in a reaction zone. The fixed bed catalyst can be placed in either a vertical or a horizontal reaction zone. If a vertical reaction zone is chosen, the sour hydrocarbon fraction can be passed upwardly or downwardly through the fixed bed. The methods of supporting beds of solid material in reaction zones are well known and need not be described in detail herein.

The sour hydrocarbon fraction is introduced into the reaction zone by a feed line and the flow is controlled by means well known in the art. The flow of the hydrocarbon fraction is controlled to give a contact time in the reaction zone so that the desired conversion of mercaptans to thioethers is achieved. Specifically, contact times equivalent to a liquid hourly space velocity (LHSV) of about 0.5 to about 10 are effective to achieve a desired conversion of mercaptans to thioethers.

Additionally, treatment of the sour hydrocarbon fraction in the reaction zone is generally effected in a temperature range of about 25° to about 350° C. with a preferred temperature range of about 25° C. to about 200° C. The reaction is carried out at a pressure of about 0.01 to about 25 atmospheres with a pressure in the range of about 1 to about 10 atmospheres being preferred.

Since thioetherification is a non-oxidative reaction, it is preferred that the contact of hydrocarbon fraction with the acid catalyst take place under a non-oxidative atmosphere. The prevention of contact between oxygen and hydrocarbon under the refinery conditions is easily accomplished using standard operating procedures.

If it is necessary to add an unsaturated hydrocarbon to the reaction zone to effect the thioetherification reaction, the unsaturated hydrocarbon can be added to the sour hydrocarbon fraction at the start of the reaction zone but well before the fixed bed acid catalyst. This will ensure that the unsaturated hydrocarbon is well dispersed in the sour hydrocarbon fraction. It is contemplated that any unreacted unsaturated hydrocarbon could be separated at the reactor outlet and recycled to the inlet of the catalyst bed.

For example, the sweetening of high molecular weight petroleum fractions (kerosene, fuel oil) might be accomplished by addition of excess isobutylene to the hydrocarbon feed over an acid catalyst. The separation and recycle of unreacted isobutylene could be employed to increase sweetening rate and minimize the use of isobutylene.

Alternatively, the entire process can be carried out in a batch process. The pressure conditions, temperature conditions and unsaturated hydrocarbon concentration employed for the flow type process can be used for a batch process. However, the contact time in the reaction zone will depend on the amount of catalyst, the size of the reaction zone, and the amount of sour hydrocarbon in the reaction zone. Based on these considerations, an appropriate conversion of mercaptan to thioether is accomplished with a contact time in the range of from about 0.05 to about 2 hours.

In some instances the acid catalyst can be deactivated by basic nitrogen compounds present in the sour hydrocarbon fraction. Thus, in order to minimize catalyst deactivation, it is desirable to treat the sour hydrocarbon fraction to remove the basic nitrogen compounds prior to contacting the sour hydrocarbon fraction with the acid catalyst.

Removal of the basic nitrogen compounds can be accomplished by several methods known in the art, including an acid wash or the use of a guard bed positioned prior to the acid catalyst. Examples of effective guard beds include A-zeolite, Y-zeolite, L-zeolite, mordenite and acidic reticular polymeric resins. If a guard bed technique is employed, it is contemplated that dual guard beds be placed prior to the reactor such that regeneration of one guard bed may be conducted while the alternate guard bed is functioning. In this manner continuous operation of the unit may be achieved. When an acid wash is desired, the sour hydrocarbon fraction can be treated with an aqueous solution of the acid. The concentration of said acid in said aqueous solution is not critical, but is conveniently chosen to be in the range of about 0.5 to about 30 weight percent. The acid which can be used to treat the sour hydrocarbon fraction may be chosen from the group consisting of hydrochloric, sulfuric acetic, etc., with hydrochloric acid being preferred.

One method of effecting the acid wash involves introducing a sour hydrocarbon stream into the lower portion of an extraction column. The sour hydrocarbon stream rises upward through contacting plates or trays toward the top of the extractor counter-current to a descending stream of an aqueous acid solution. Upon contact of the aqueous acid solution with the sour hydrocarbon fraction, the basic nitrogen compounds contained in said sour hydrocarbon fraction are extracted into the aqueous acid solution. The sour hydrocarbon fraction continues upward past the point in the upper portion of the column at which the aqueous acid solution is introduced and then is removed. The resultant basic nitrogen compound containing aqueous acid solution is removed from the bottom of the reactor and disposed.

This acid wash treatment is usually done at ambient temperature and atmospheric pressure, although temperatures in the range of about 20° to about 70° C. and pressure in the range of about 1.0 to about 17.2 atmospheres can be used. The rate of flow of the acid solution will be about 0.1 times to about 3.0 times of the rate of flow of the sour hydrocarbon feed. Carrying out the acid wash under the above conditions will generally result in the removal of about 60–95+ weight percent of the basic nitrogen compounds.

In order to more fully illustrate the advantages to be derived from the instant invention, the following examples are provided. It is to be understood that the examples are by way of illustration only and are not intended as an undue limitation on the broad scope of the invention as set forth in the appended claims.

EXAMPLE I

A macroreticular polymeric sulfonic acid resin was obtained from the Rohm and Haas Co. This resin is sold under the name Amberlite XE-372 and comes in the shape of spheres about 16–50 U.S. mesh size (1.19 mm to 297 micron diameter). The resin was used as received and was designated catalyst A.

EXAMPLE II

A macroreticular polymeric sulfonic acid resin was obtained from the Rohm and Haas Co. This resin is sold under the name Amberlyst 15 and comes in the shape of spheres about 16–50 U.S. mesh size (1.19 mm to 297 micron diameter). The resin was used as received and was designated catalyst B.

EXAMPLE III

A macroreticular polymeric sulfonic acid resin was obtained from the Rohm and Haas Co. This resin is sold under the name Amberlite 252 and comes in the shape of spheres about 16–50 U.S. mesh size (1.19 mm to 297 micron diameter). The resin was used as received and was designated catalyst C.

EXAMPLE IV

An intercalate compound consisting of antimony pentafluoride on graphite was obtained from Alfa Chemical Co. This catalyst was used as received and was designated catalyst D.

EXAMPLE V

A solid phosphoric acid catalyst was prepared by adding kieselguhr powder to an 85% polyphosphoric acid solution and mixing for 3–7 minutes. After formation of a consistent mixture the material was extruded, sized and dried at 380° C. This catalyst was designated catalyst E.

EXAMPLE VI

Catalyst F was prepared by passing $BF_3$ gas at an hourly space velocity of 700 $hr^{-1}$ over an anhydrous gamma alumina support for two hours. The catalyst was loaded into the reactor under a nitrogen atmosphere.

EXAMPLE VII

This example describes the apparatus which was used to evaluate the activity and durability of the catalysts described in Examples I to VI. A catalyst (50 cc) was loaded into a 0.5" by 6.5" catalyst zone and supported by screens.

In the standard test method, the reactor zone containing catalyst was purged with nitrogen for a sufficient time to remove all gaseous oxygen from the system. The sour hydrocarbon feedstock containing approximately 200 weight ppm of mercaptans sulfur under a nitrogen blanket was fed to the catalyst zone in the liquid phase at a rate of 100 cc/hr, equivalent to a LHSV=2.0 $hr^{-1}$. The reactor zone inlet temperature was controlled at 30° C. and the reactor pressure was one atmosphere. Samples were taken for mercaptan analysis at regular intervals of 1 hour utilizing a nitrogen-purged sampling box. The temperature in the catalyst zone was measured hourly to determine the extent of the exothermic reaction versus time on stream. No addition of olefin was made to the feedstock. The properties of the sour FCC gasoline feedstock are given below:

TABLE 1

| SOUR FCC GASOLINE PROPERTIES | |
|---|---|
| Mercaptan Sulfur, wppm | 193 |
| Total Sulfur, wt % | 0.32 |
| A.P.I. Gravity, 60° F. | 56.8 |
| Aromatic content, % | 29.0 |
| Olefin content, % | 24.9 |
| Paraffin content, % | 46.1 |
| End Pt., °C. | 220° C. |

EXAMPLE VIII

Results of the activity test as described in Example VII are presented in Table 2.

TABLE 2

| Catalyst I.D. | Mercaptan Conversion, Percent |
|---|---|
| Catalyst A | 88 |
| Catalyst B | 88 |
| Catalyst C | 18 |
| Catalyst D | 95 |
| Catalyst E | 93 |
| Catalyst F | 85 |

The results presented in the Table show that a variety of acidic catalysts will convert mercaptans to thioethers. Additionally, the data show that the antimony intercalate compound is the preferred catalyst.

EXAMPLE IX

A silica-alumina catalyst was prepared by binding mordenite zeolite in a gamma alumina binder. The mordenite content was 90%. The catalyst was evaluated at the following conditions: (1) sour FCC gasoline containing 192 wppm mercaptan sulfur; (2) liquid hourly space velocity=5; 3) temp=50° C.; 4) pressure=18 atm.; 5) 1.6% isobutylene added. The results indicate that the mercaptan content was reduced by 20% through 10 total hours on stream.

EXAMPLE X

A new portion of catalyst A was evaluated according to the procedure in Example VII. Specifically, the operating conditions were: (1) the sour hydrocarbon fraction was an FCC gasoline containing 355 ppm of mercaptans; (2) the liquid hourly space velocity (LHSV) was 5; 3) the reactor temperature was 50° C.; 4) the pressure was 9.2 atm.; and 5) 13.6% weight percent of isobutylene added. The evaluation was carried out for forty hours to determine the durability of the catalyst. The result of this evaluation are presented in FIG. 1. FIG. 1 presents a graph of the amount of mercaptan left in the treated hydrocarbon fraction as a function of time. The results indicate that the catalyst is converting at least 235 ppm (66%) of the mercaptans to thioethers for the duration of the test.

EXAMPLE XI

During the evaluation of particular acid catalysts, it was found that deactivation of the catalyst was occurring. Extensive tests were performed to determine the causes of this deactivation and it was concluded that the acid catalyst can be deactivated by basic nitrogen compounds found in the sour hydrocarbon fraction. It was also discovered that an acid wash could remove most of the basic nitrogen compounds. This example presents durability results of an acid catalyst tested with an FCC gasoline that was given an acid wash and an FCC gasoline that was not given an acid wash.

A portion of an FCC gasoline was given an acid wash as follows. The acid wash of the FCC gasoline was performed batchwise with a 10 weight percent solution of aqueous HCl and an FCC gasoline/$H_2O$ volumetric ratio of 4/1. The acid wash removed 67% of the nitrogen compounds (single-stage extraction) while reducing the thiol content only slightly from 193 wppm to 171 wppm mercaptan sulfur. This acid washed sour hydrocarbon fraction was treated using a new portion of catalyst B and the apparatus described in Example VII. Specifically, the operating conditions for this experiment were: (1) LHSV=5.0; 2) Reactor temperature=50° C.; 3) pressure=9.2 atm.; and 4) 13.6 weight percent of isobutylene added.

Figure 2:
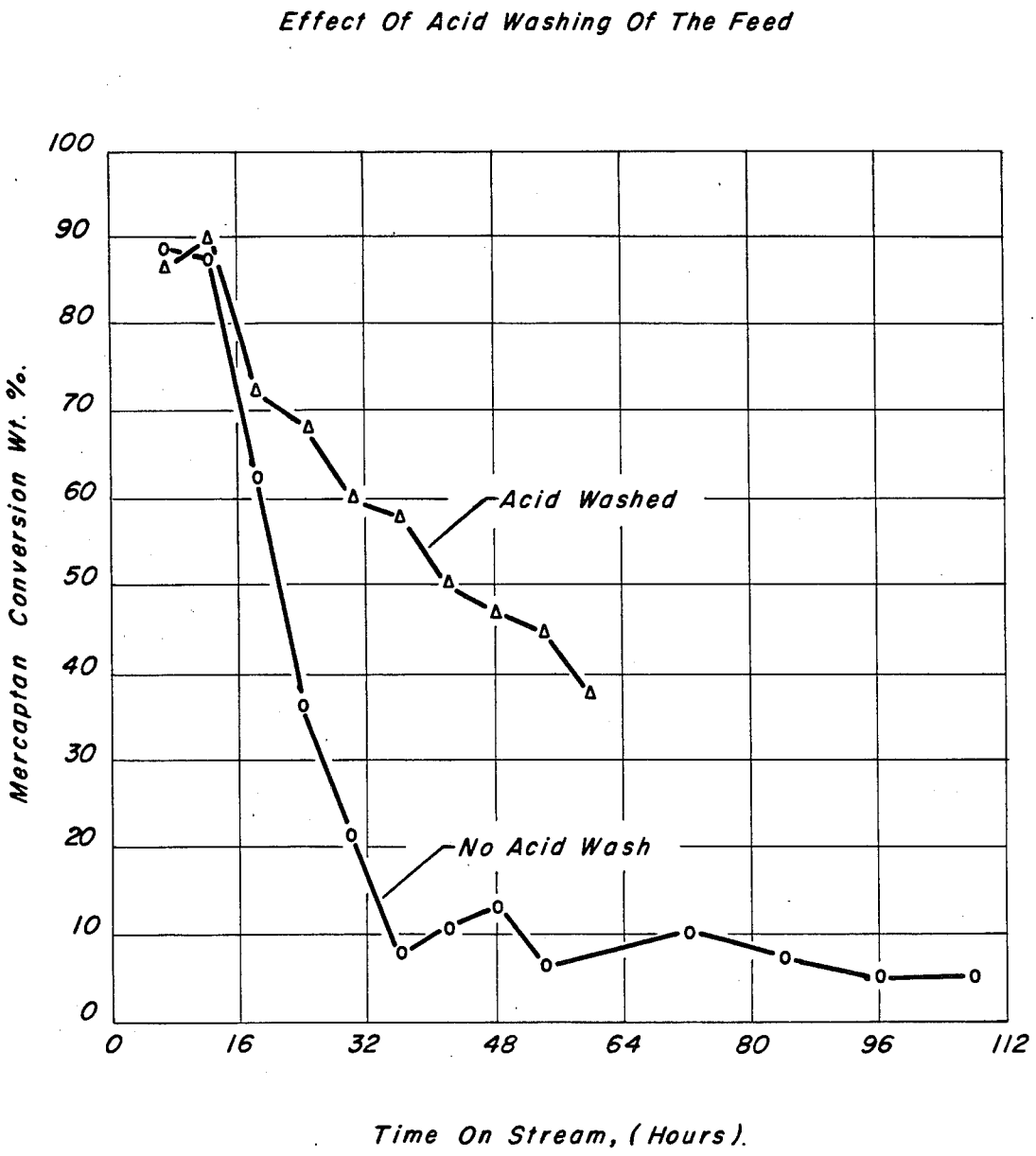
FIG. 2 is a graphical comparison of the durability of catalyst A when it is used to treat an acid washed sour hydrocarbon stream versus when it is used to treat an unwashed sour hydrocarbon stream. The conversion of mercaptans to thioethers is plotted versus time on stream.

A second portion of the same FCC gasoline was treated without an acid wash using a new portion of catalyst, but the same operating conditions as in the above paragraph. The results from both these experiments are presented in FIG. 2. FIG. 2 presents plots of mercaptan conversion to thioethers versus time on stream. The plots show that acid washing the sour hydrocarbon fraction prior to contacting it with the acid catalyst improves the durability of the catalyst. Thus, an acid wash is a means to improve the durability of the acid catalyst.

We claim as our invention:

1. A process for sweetening a sour hydrocarbon fraction which comprises reacting a mercaptan contained in said hydrocarbon fraction with an unsaturated hydrocarbon by contacting said sour hydrocarbon fraction containing at least a concentration of an unsaturated hydrocarbon equal to the molar amount of mercaptans present in said sour hydrocarbon fraction with an acid catalyst selected from the group consisting of an acidic inorganic oxide, a polymeric sulfonic acid resin, an intercalate compound, a solid acid catalyst, a boron halide dispersed on alumina, and an aluminum halide dispersed on alumina, under a non-oxidizing atmosphere at reaction conditions, thereby converting said mercaptans to thioethers and recovering said sweetened hydrocarbon fraction.

2. The process of claim 1 where said unsaturated hydrocarbon is present as a component of said sour hydrocarbon fraction.

3. The process of claim 1 where said unsaturated hydrocarbon is added to said sour hydrocarbon fraction in a concentration of at least the molar amount of the mercaptans in said sour hydrocarbon fraction to about 20 weight percent of the sour hydrocarbon fraction prior to contacting said sour hydrocarbon with said acid catalyst.

4. The process of claim 1 where said unsaturated hydrocarbon contains a tertiary carbon atom.

5. The process of claim 1 further characterized in that said hydrocarbon fraction is an FCC gasoline.

6. The process of claim 1 further characterized in that said hydrocarbon fraction is kerosene.

7. The process of claim 1 further characterized in that said reaction conditions comprise a temperature in the range of from about 25° to about 350° C., a pressure in the range of from about 0.01 to about 25 atmospheres and a liquid hourly space velocity in the range of from about 1 to about 10.

8. The process of claim 1 where said acidic inorganic oxide is selected from the group consisting of alumina, silica-alumina, mordenite, L-zeolite, omega-zeolite, X-zeolite and Y-zeolite.

9. The process of claim 1 where said solid acid catalyst is phosphoric acid dispersed on alumina.

10. The process of claim 1 where said intercalate compound is antimony pentafluoride on graphite.

11. The process of claim 1 where said intercalate compound is a zirconium halide on graphite.

* * * * *